United States Patent [19]

Smagner

[11] Patent Number: 5,062,249

[45] Date of Patent: Nov. 5, 1991

[54] FURNACE CROWN MEANS AND METHOD

[76] Inventor: John D. Smagner, 109 South Ave., Watkins Glen, N.Y. 14891

[21] Appl. No.: 382,987

[22] Filed: Jul. 20, 1989

[51] Int. Cl.[5] ..... E04C 1/24

[52] U.S. Cl. ..... 52/320; 110/331; 110/336; 52/482

[58] Field of Search ..... 110/331, 332, 336, 330; 52/320, 482, 484

[56] References Cited

U.S. PATENT DOCUMENTS

| | | | |
|---|---|---|---|
| 1,463,241 | 7/1923 | Bigelow | 110/332 |
| 1,472,945 | 11/1923 | Strachota | 110/331 |
| 1,506,458 | 8/1924 | Strachota | 110/331 |
| 1,666,284 | 2/1930 | Gilchrist | 110/332 |
| 1,913,168 | 6/1933 | Longenecker | 110/331 |
| 3,234,703 | 2/1966 | Sullivan . | |
| 3,313,254 | 4/1967 | Birse . | |
| 3,340,832 | 9/1967 | Grigsby . | |
| 4,081,236 | 3/1978 | Corbett . | |
| 4,083,155 | 4/1978 | Lampert . | |
| 4,317,418 | 3/1982 | Courshon et al. . | |
| 4,529,178 | 7/1985 | Hosbein et al. . | |
| 4,539,919 | 9/1985 | Bossetti . | |
| 4,628,657 | 12/1986 | Ermer et al. | 110/331 X |

*Primary Examiner*—David A. Scherbel

*Assistant Examiner*—Linda J. Hoffert

*Attorney, Agent, or Firm*—Ralph R. Barnard

[57] ABSTRACT

The invention herein teaches a crown system for kilns and furnaces for the high temperature firing of materials. One method used in the industry for a crown system consists of supporting layers of insulation with inverted T-rails attached to bones which are further attached to hanger devices hanging from pipes that rest upon an ultimate support system. To overcome the numerous problems associated with the prior art the following considerable modifications have been made: 1) slotting each inverted T-rail, along its narrow attaching flange and adding stops to each side of said slot such that the bone is evenly spaced along the T-rail when inserted and slid into position, 2) fitting rigid insulation cases fully between the bones and adjacent layers of insulation and 3) said insulation cases and said T-rail stops combine to lock said bones in position. Further improvements to this system include: 1) widening the T-rail's broad base width, 2) angling the ends of the T-rail, 3) increasing the bone's stem length, 4) placing stops on the ultimate support system to hold the pipes in place, 5) a thermal tent which envelopes the bone's upper attaching end and 6) shaping the attachment hole on the bone as a curved cylinder.

12 Claims, 8 Drawing Sheets

FURNACE CROWN MEANS AND METHOD

BACKGROUND OF THE INVENTION

1. Field of the Invention

This invention relates to a method of construction, as well as, apparatus for a furnace crown or the like. More specifically this invention deals with the means and method of maintaining the support and integrity of said crown, and a means and method by which the problems associated with maintaining the integrity of the crown can be overcome. The invention taught herein is suitable as a crown for use with furnaces operated at high temperatures. The teachings of the present invention also apply to suspension systems for ceilings in commercial, industrial and residential construction circumstances.

Known in the art are many methods of constructing furnace crowns, the most common method being the traditional vault type which has in its commonest form a semicircular or arch section resting on two sidewalls. This description is familiar to those skilled in the art and has been a preferred method of kiln construction since the earliest recorded history of kiln construction. However, constructing a furnace crown using this method (and constructing the necessary side walls to support said crown) involves considerable construction costs both with respect to materials utilized and complexity of construction.

The crown of a kiln of this prior art must have considerable thickness in order to be effective as an insulator. In order to support this mass the sidewalls must be large. The enormous mass of the structure requires large amounts of energy in order to reach a temperature high enough for modern ceramic firing. The mass of the structure, and the excessive retention of heat, results in extended cool down time which inhibits maintenance of the crown and replacement of ceramic materials to be fired.

Other problems with this prior art and its derivatives, are that refractory materials used in the construction of these furnaces tend to deteriorate and cause faults with the material being fired by contact. This prior art method of construction leaves little or no possibility of economical reconstruction and rehabilitation of the furnace.

2. Description of the Related Art

Besides the numerous variety of forms generally derived from the construction method described above, there exist a number of suggested ways to suspend refractory brick, and systems developed to suspend whole furnace crowns. Most relevant to the present invention would be "Supporting Structures for Furnace Crowns" U.S. Pat. No. 4,539,919 9/1985, Bossetti, which depicts inverted "T" beams and anticipates their ability to suspend insulating material. However, the invention referred to therein has no other supporting mechanism other than reliance upon the strength of the sidewalls of the supporting structure. The present invention disclosed herein provides for a system of supports which greatly enhance the weight bearing capacity, longevity, and ease of maintenance of the furnace crown.

Furthermore, there are quite a number of methods for suspending refractory brick from structures which do not contribute to the insulating qualities of the furnace crown. An example of such a supporting structure is the "Thermally Insulated Enclosure" U.S. Pat. No. 4,083,155 4/1978 Lampert. A defect in the Lampert method of constructing furnaces is the interdependence of the various suspended blocks of insulating material, which makes for costly maintenance in the event of a failure of one section.

Other such structures suspend insulating material other than refractory brick, such as "Kilns" U.S. Pat. No. 4,081,236 3/1978, Corbett. However, this system fails to address the problem of section failure and subsequent maintenance of the structure.

Finally, refractory brick has been patented with support means constructed into the brick, such as "Ceiling and Wall Construction" U.S. Pat. No. 4,628,657 12/1986, Ermer. However, this system also relies on the structural interdependence of each brick, using "bearing bricks" to act as insulators and support structures without the possibility of replacing individual sections of the crown or sections of the support mechanism without resorting to the destruction of the viability of the entire structure.

Still another means and method used in industry consists of using an inverted T-rail comprised of a suitable ceramic material attached to a ceramic bone which is further attached to a hanger device. A number of these T-rail/bone/hanger assemblies are suspended from a support system forming adjacent rows. Layers of insulation, a combination of board and blankets, of a determined size and temperature resistance are supported by and evenly separate these inverted T-rail rows.

Numerous problems are associated with this system. The individual T-rails which comprise the rows have a constant width attachable end, thus when removing or replacing any of these ceramic attachment bones it must be done by sliding it off the end of the individual T-rail (i.e. at a T-rail junction). This is quite inconvenient because it requires disruption of the T-rail row as well as the insulation layer. The portion of these T-rails supporting the insulation does not cover an adequate surface area of the insulation thus resulting in eventual sagging of this insulation. The bones, as referred to above, are slid into place and are not held into position by the bulk wool which is placed between them, thus the bones move during kiln vibration causing considerable stress upon these bones, eventually leading to breakage. In this system the insulation layers completely encompass the attachment bone as well as the curved lower portion of the hanger. Because of this exposure to considerable heat, as well as the drastic change in temperature (insulated to external air) these hangers fail over time. The bulk wool used to fill in the area found above the T-rails and the between the insulation rows is thermally inefficient and is difficult to remove when replacing the bones and/or T-rails. The bone'5 attachment hole through which the hanger is hooked is shaped as a straight cylinder providing only two points of contact (i.e. stress) between the bone and hanger, again leading to considerable breakage of these "bones". (See FIG. 13 for prior art)

3. Objectives of the Invention

Accordingly it is an object of this invention to teach a new and improved method and means for a kiln crown system.

Another objective is to create a furnace crown which can easily be maintained with replaceable support structures and insulating material such that said supporting mechanisms and insulating materials may be replaced without the need for dismantling the entire crown or causing the remaining sections of the crown to become unstable.

Still another object of this invention is to create a system of crown construction such that the structural integrity of the whole system and its component parts is enhanced.

Still another object of this invention is to allow the crown to withstand and efficiently insulate temperatures in excess of 3000° F. while protecting the supporting components from thermal shock.

Still another objective is to provide for a efficient method of construction for a kiln crown system.

Still another objective of the invention is to provide for a new and improved T-rail such that the design of the T-rail provides for easy installation as well as removal during repair of a kiln crown.

Still another objective is to provide for a new and improved T-rail with a slot and stop system which allows the T-rail to be easily attached to a suspension means.

One final objective is to provide for a kiln crown system, as well as a method for accomplishing a kiln crown system, which has an easily adjustable height.

These and still further objectives will become apparent hereinafter.

SUMMARY OF THE INVENTION

These and other objects are achieved by a kiln crown system (as well as a method for construction for this kiln crown), for the high temperature firing of materials. As was previously discussed one means and method used in industry for a kiln crown system consisted of using an inverted T-rail comprised of a suitable ceramic material attached to a ceramic bone which is further attached to a hanger device. As stated in the paragraph preceding the objectives this system contained at least six major shortcomings.

To overcome the numerous problems associated with this prior art T-rail system considerable modifications have been made to that prior art system. Specifically, the invention herein teaches a kiln crown structure for furnaces used to fire materials at a high temperature comprising inverted ceramic T-rails which includes a slotted narrow attaching flange, a broad base flange parallel to the first and a T-rail web that connects the two flanges, such that when placed end to end form T-rail rows, which are suspended from pipes using ceramic bones and hanger devices, with the said pipes being supported by an ultimate support system, and layers of insulation supported by and evenly separating the T-rail rows, said ceramic bones including a T-rail attachment end with an opening for attachment to said T-rail, a hanger attachment end with a hole for attachment to said hanger device and a stem connecting the two ends wherein generally speaking increasing the number of evenly spaced bone hanger attachments improves the suspension system, wherein the improvement includes the following modifications: 1) slotting each inverted T-rail, along its narrow attaching flange, to allow for easier attachment and removal of the said ceramic bones and adding stopper means to each side of the said slots, such that the slot evenly separates the stops, which allows the bone to be slid into place thus allowing the said bones to be evenly spaced upon suspended T-rail, 2) fitting rigid insulation cases securely and fully into the space formed between the said bones, above and against said T-rail and between adjacent, parallel insulation rows and 3) said insulation cases and T-rail stopper means combine to lock said ceramic bones providing for better support of the T-rails system which in turn reduces the stress upon the said bone.

Further minor improvements to this system include: 1) widening the T-rail's broad base width which supports the insulation, such that when combined with the adjacent inverted T-rail, their combined width is wide enough to prolong sagging of the supported insulation, 2) angling the ends of the T-rail, from the top narrower flange to a point intersecting along the T-rail's web approximately ½ way between broad base flange and narrow attaching flange thus forming a V-shaped groove when the T-rails are place end to end, 3) increasing the ceramic bone's stem length, 4) placing stopper means on the ultimate support means prohibiting pipe movement, 5) providing for a thermal tent which envelopes the bone's upper attaching end and thus the hanger device's lower hooking portion, 6) shaping the attachment hole on the bone as a curved cylinder with a radius the same as that of the hanger device's bottom hooking portion.

Additionally a unique method of installing the insulation has been developed. It involves completing the first seven layers of insulation (two of refractory board and five of various grades of insulation blanket), by placing them on the broad base of, and evenly separating, the adjacent T-rail rows. Next the rigid insulation cases (placed between the ceramic bones and adjacent rows of insulation) and V-shaped plugs of insulation (placed in the V-shaped groove formed by the end to end angled T-rails) are applied. Lastly an aluminum layer which will form the thermal tent and a layer of foil backed insulation are put into place.

The method of repair for this kiln crown is quite simple and comprises the following steps: 1) unfolding the thermal tent, 2) removing the appropriate rigid insulation case, 3) completing the repairs by removing the damaged T-rail and/or ceramic bone, bone and 4) placing removed case(s) back into its proper case hole and pushing the case back into position, completing the repair process by refolding the thermal tent.

This kiln crown system may be modified to allow an easy method of changing the height of a kiln crown system. The steps, simply are as follows: 1) placing, on the ultimate support member on both sides of kiln crown supporting pipe, pipe movement control mechanisms of a height such that they cover the range of desired height movement and 2) placing under the pipe a shim device of a height equal to the height of crown movement desired. This method is especially desirable because it allows kiln designers to easily match the kiln crown placement height to that of the kiln walls.

DETAILED DESCRIPTION OF THE PREFERRED EMBODIMENT

Figure 1:
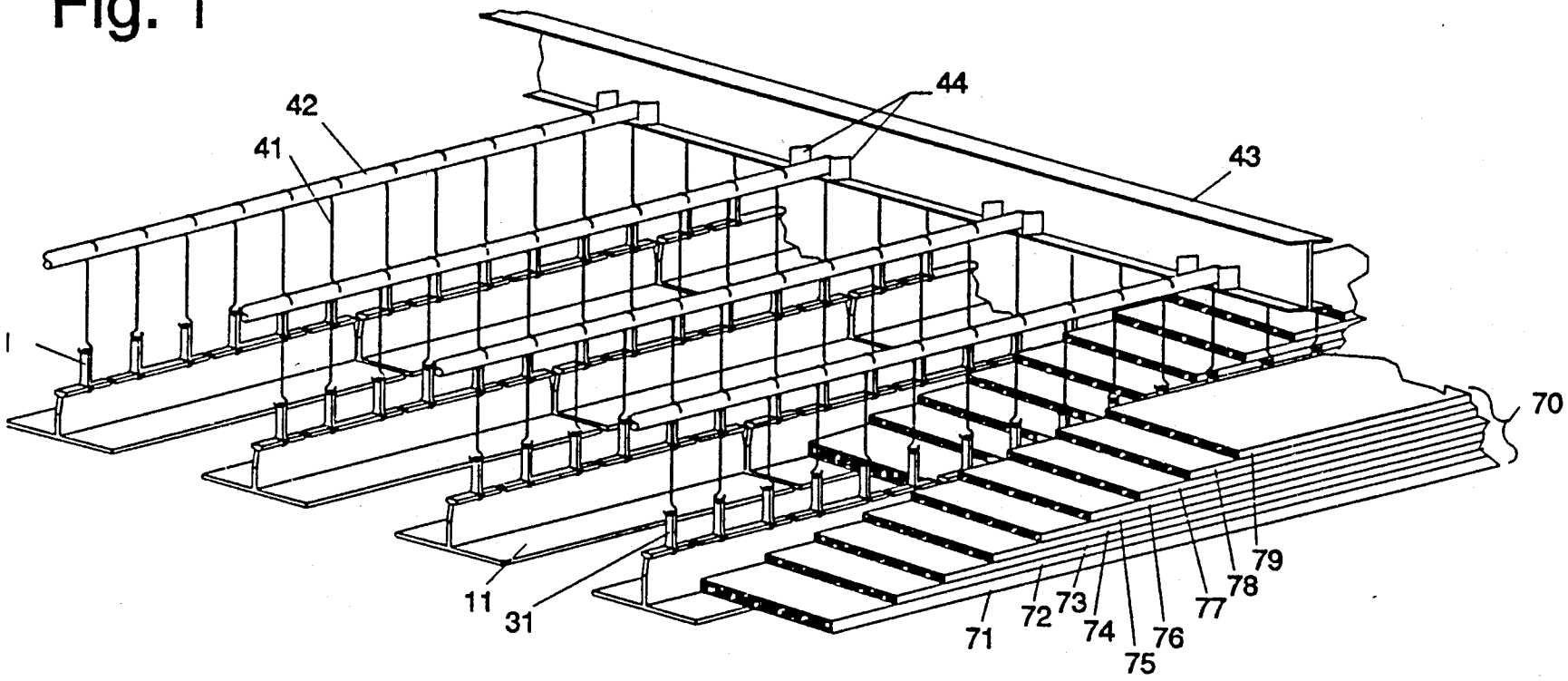
FIG. 1 is a diagrammatic representation of partially complete crown system including I-Beams as the ultimate support means.

Turning now to FIG. 1, shown is a kiln crown structure for furnaces used to fire ceramic materials at a high temperature, including, inverted ceramic T-rails (11) which include a slotted narrow attaching flange, a broad base flange parallel to the first and a T-rail web which connects the two flanges, such that when placed end to end form T-rail rows, which are suspended from pipes (42) using ceramic bones (31) and hanger devices (41), with the said pipes being supported by an ultimate support system (43), and layers of insulation (70) supported by and evenly separating the T-rail rows, said ceramic bones including a T-tail attachment end with an opening for attaching to said T-rail, a hanger attachment end with a hole for attachment to said hanger device and a stem connecting the two ends. Wherein generally speaking increasing the number of evenly spaced bone hanger attachments improves the suspension system.

Figure 7:
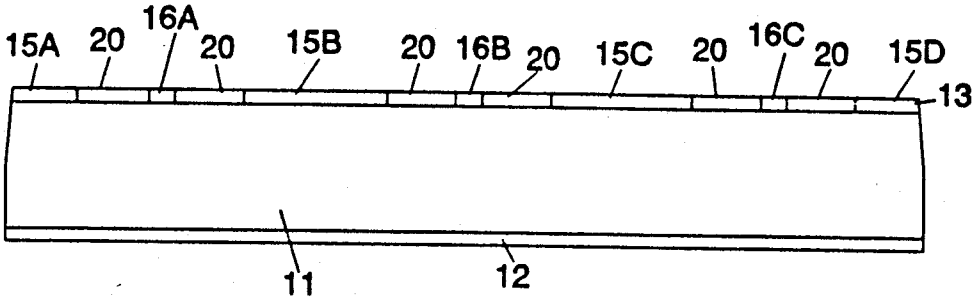
FIG. 7 is a diagrammatic representation of a side view of a single T-rail beam emphasizing the slots for attaching the bones.
Figure 8:
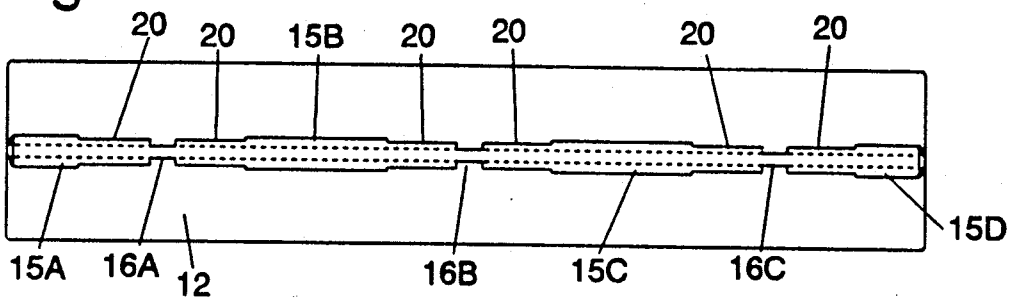
FIG. 8 is top view of FIG. 7.
Figure 9:
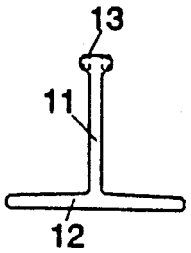
FIG. 9 is a diagrammatic representation of an end view of a single T-rail beam.

Looking to FIGS. 7–9 the T-rail (11) would be comprised of an alumina material, which is the native form of aluminum oxide ($Al_2O_3$) and is added to fireclay bricks for high temperature applications, although any suitable heat resistant material could be used, this is the same material as is used in the prior art T-rails manufactured by the Ferro Corp's Refractory Products Division, Buffalo, N.Y. This T-rail would have a length that would be determined by the manageability of one person so that the T-rail (11) poses no danger to the person installing or repairing the T-rail. For example one method used to determine the T-rail length is to measure the distance between the ultimate support system's I-beams, center to center, (for example assume 63" for calculation purposes). From this number 1" is subtracted to compensate for thermal expansion (After the first couple of initial firings the T-rails will expand together). This final number is then divided by 2 to obtain the proper length of each of the T-rails. Using this technique each of the T-rails was calculated to be 31" long. Additionally the T-rails are 5⅜" high and weigh 10½ lbs. It must be reiterated that this technique is for example only and any dimensions which would be suitable to one skilled in the art would be within the scope of the invention.

Looking now at FIGS. 7 and 8 the T-rail has an narrow attaching flange (13) with three distinct widths, consisting of a narrow width slot means, ⅞" long, (16A–C), width being no greater than the T-rail's web width thus allowing bone (31) to be inserted along the T-rail (11). The second is a middle width slide means (20), width slightly smaller than the width of the bones attachment opening (FIG. 5, No. 34), thus allowing the "bone" (31) to slide along it. The third is a wide width stop means (15A–D), width being wider than the aforementioned bones attachment opening thus not allowing movement of the bone past it. This slot means (16) is placed in the middle between opposing slide means (20) and stop means (15), such that once the bones are placed in position by sliding them up against the stop means (15) each positioned bone (31) may be easily removed without disturbance of any other.

Assuming six bones as the exemplary number for adequate support this would then mean having 3 stop/slot/stop systems per T-rail. Using this stop/slot/stop system a method of ceramic bone insertion has been developed. The steps, looking again at FIGS. 7 and 8, are as follows: 1) placing on the slot (16A) a ceramic bone (31) and sliding it into place against the stop (15A), 2) placing on the same slot (16A) another bone (31) and sliding this bone in the opposite direction up against the opposing stop (15B), 3) repeating this for each slot (16B,C) that is found on the T-rail (11).

Figure 3:
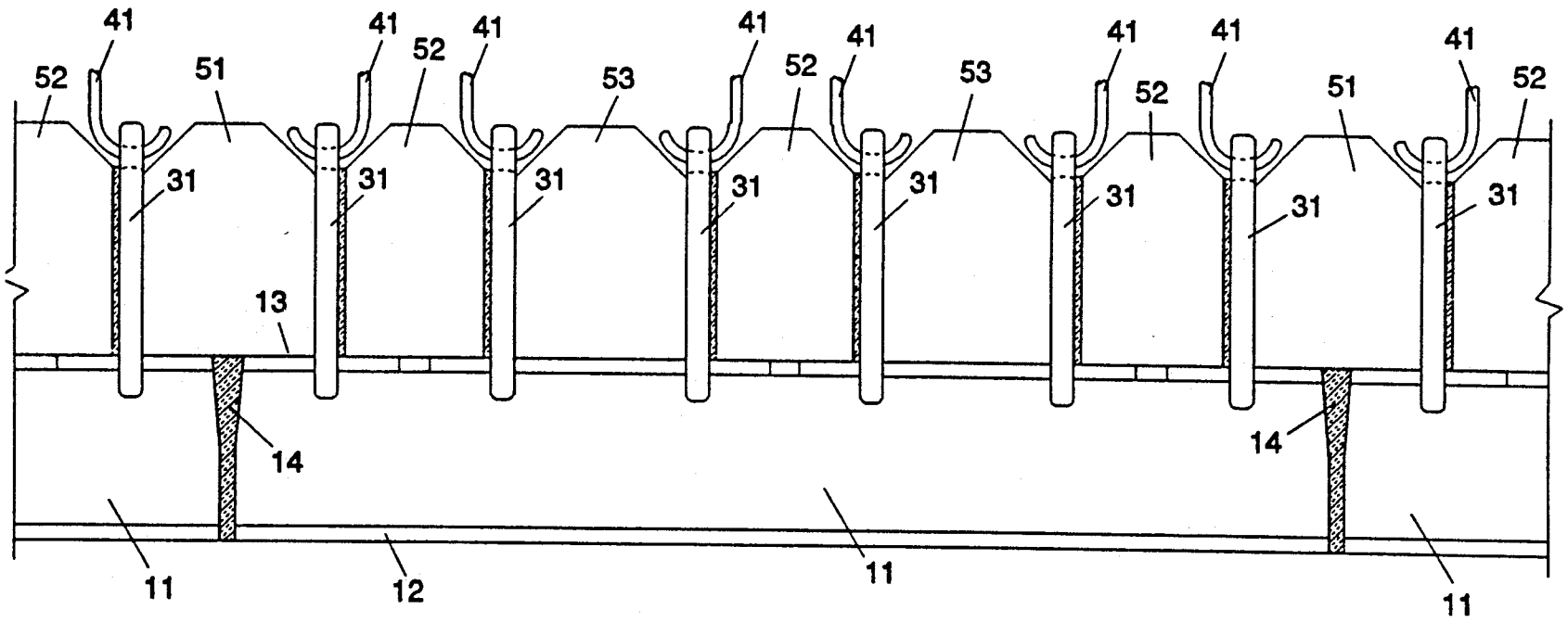
FIG. 3 diagrammatic representation of a side view of a T-rail beam adjoining another with suspension bones and insulation cases included therein.

Looking at FIG. 3 for completed and proper bone positioning it is shown that the stop means are placed so that when the bones (31) are slid into place they are equally spaced throughout the T-rail. By placing the bones (31) into these proper positions using these stop means (15 A–D) the balance and support of the T-rail is enhanced such that if the T-rail was to break, the bones should supply enough support that the T-rail will not sag causing more problems. For example, assuming a 29¾" T-rail and 6 bones the stops would be positioned so that the bones would be 4¼" apart in their locked position. These measurements are only exemplary and should not be taken so as to limit the scope of the invention taught herein.

Figure 4:
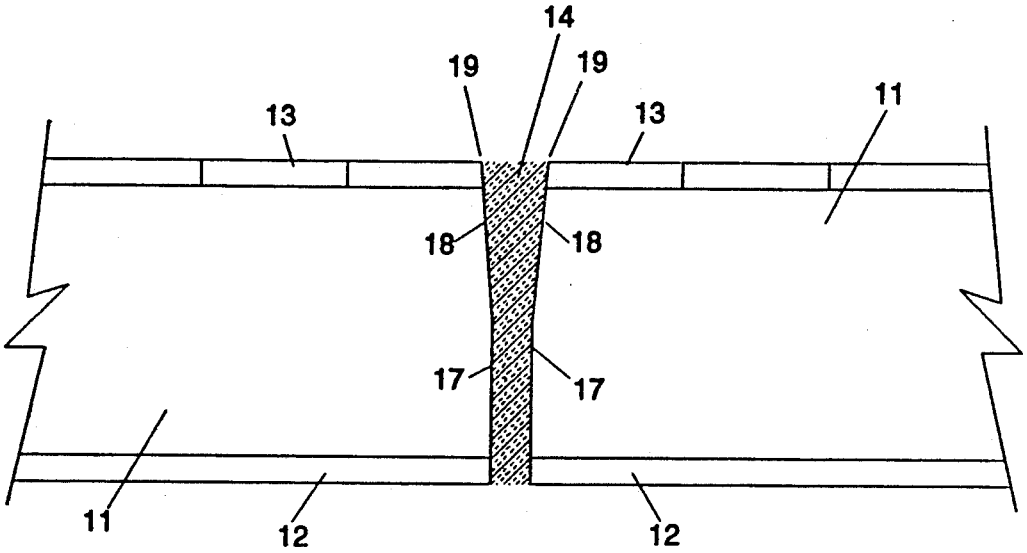
FIG. 4 is a close up view of FIG. 3 showing only the V-shaped groove formed by the adjoining T-rail beams.

Referring to FIG. 4 it can be seen that the new T-rail is angled at both ends, from the top narrow attaching flange (19) to a point intersecting along said T-rail's web (17) approximately way ½ between the broad base flange and narrow attaching flange such that when individual T-rails are placed end to end a V-shaped groove is formed. This angle (18) will begin ¼" in, along the top flange (19) of the T-rail and end at a zero point (17) along its web, 2¾" from the bottom base flange, or approximately where the second course of insulating board intersects the T-rail. This V-shaped groove is provided so that if ever the T-rails, after placement, have to be replaced this V-shaped groove will allow for easier replacement of a new T-rail. The V-shaped groove formed from two T-rails put end to end is designed such that the groove begins above the two courses of insulating board thus providing a better seal and the groove is desigined such that it is smaller than the width of the bone thus a bone could not be mistakenly installed on the end as oppossed to the slot means. A piece of KAWOWOOL 2600 BLANKET is placed in this V-shaped groove (14) and when the T-rails expand during the first firing this blanket forms a tight seal as the T-rails expand and come together. This blanket also acts as a shock absorber. (See also FIG. 3).

Figure 2:
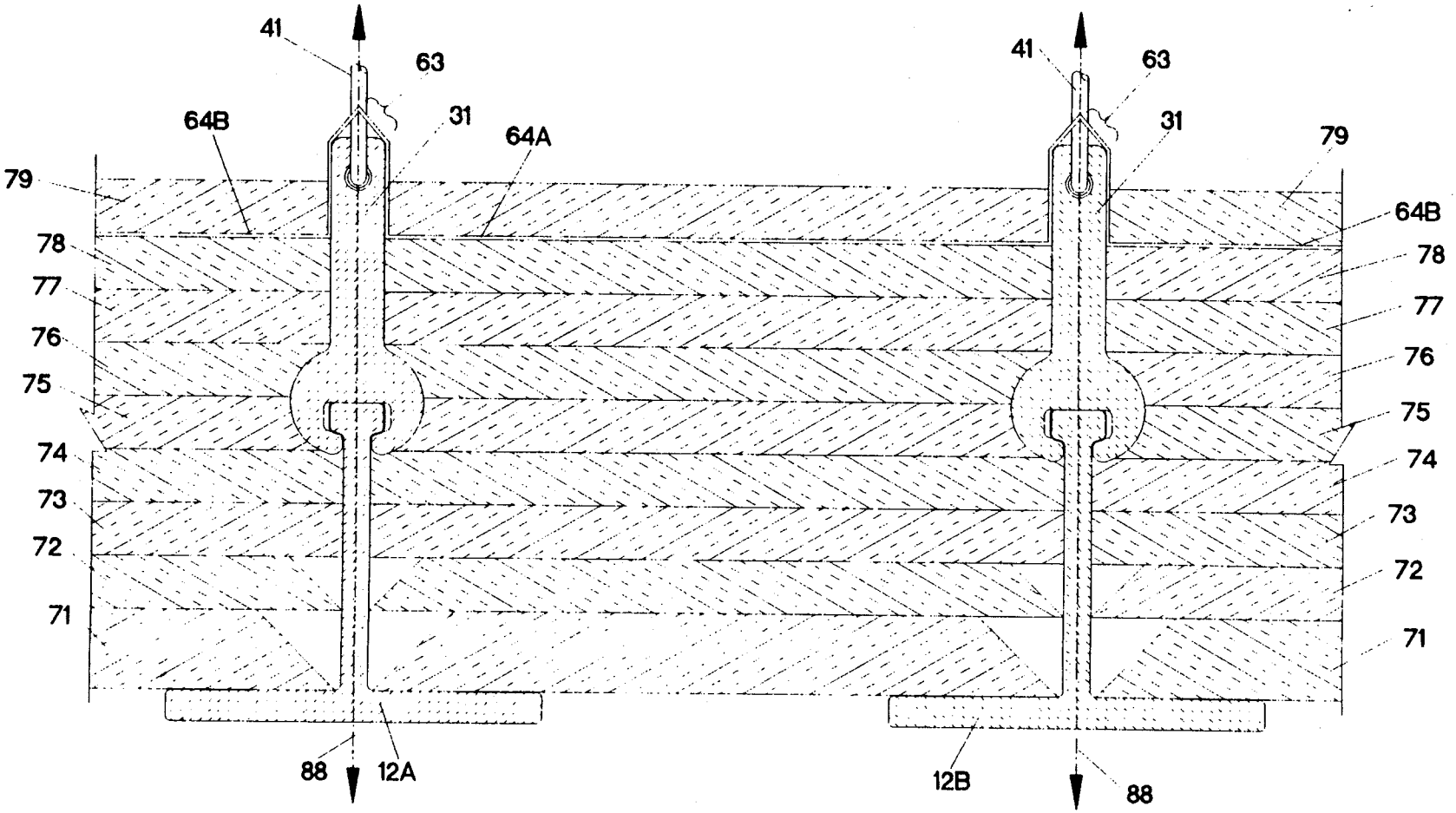
FIG. 2 is a diagrammatic representation of a end view cutout of the T-rail row with adjacent, insulation rows and the hanger/bone suspension assembly included.

Taking a look at FIG. 2, two additional dimensions of the T-rail that should be pointed out are: 1) the T-rail will also be tall enough to accept the second course of HP 2600° F. blanket (74) which can be tucked snugly under the top rib (12) for a better seal, such that the tight seal protects heat and flame from going above the T-rail and 2) the inverted T-rail's broad base (12) which supports the insulation is wide enough so that, when combined with the adjacent inverted T-rail's broad base's (12A) width, the combined width is great enough to prevent sagging of the supported insulation over time. This width is variable and depends upon a number of factors including the weight of the insulation, the time period itself and the cost of the increased width to the T-rail. Taking these factors into consideration one skilled in the art can determine the proper width of the broad base flange of this T-rail.

Figure 14:
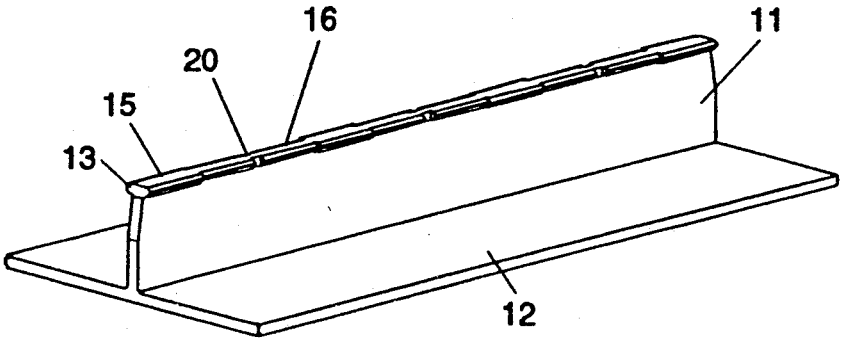
FIG. 14 is a diagrammatic representation of the individual T-rail showing its varied width top flange.

The teachings of the present invention as it relates to a T-rail with its slot and stop means, though invented for use in kiln crowns, has utility outside of the kiln industry and should be apparent to those skilled in the applicable art. For example this T-rail (11) has application for use in suspended ceilings in institutional, commercial, residential and any other types of building construction. Specifically these applications would occur where there is a need for use of an inverted T-rail suspended from a ceiling joist in a uniform manner and under circumstances where the suspension means are located at regular, defined intervals. FIG. 14 shows an individual T-rail for use in this application wherein what is shown is an inverted T-rail for attachment to a, suspension means with a constant width attachment opening, comprises of, an upper narrow flange (13) and a base broad flange (12), wherein narrow flange contains three distinct widths, a narrow width slot means (16), width being approximately that of the T-rail's web width, a middle width slide means (20), width being slightly smaller than the width of the suspension means attachment opening, a wide width stop means (16), width being greater than the width of the suspension means attachment opening. In such applications, the suspension means with a constant width attachment opening described herein as a bone could be made of a different material other than that used in the kiln crown application because of the different temperature considerations. Similarly the inverted T-rail with its slots could be made of other materials, other than those suggested herein, because the ambient temperature range would be significantly different. The above notwithstanding, fire retardation and insulation qualities are required for suspended ceilings but over a different range. On the other hand the need for uniformity of load carrying support means coupled with ease of installation and repair is common with kiln crown applications. The attachment means in the kiln crown application shown as a, bone cooperating with a hanger device, could, using the teaching of the present invention, be made into a one piece attachment of variable length with a constant width attachment opening for attachment to the slots of the of inverted T-rail. The upper part of the same being adapted for suspension from the ceiling joust in any of the known ways including hooks and/or eyelets. Lastly, in this non kiln crown application the insulation layer numbers as well as the quality of the insulation, can be considerably less. Succinctly stated, application of the T-rail taught herein should not be limited to the kiln industry, i.e. suspended ceiling uses should be within the spirit of the present invention.

Figure 5:
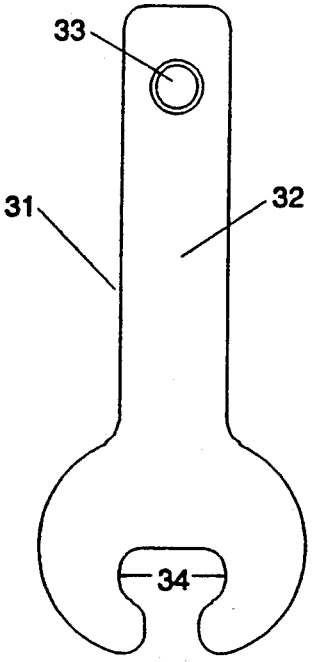
FIG. 5 is a diagrammatic representation of a single attachment bone.
Figure 6:
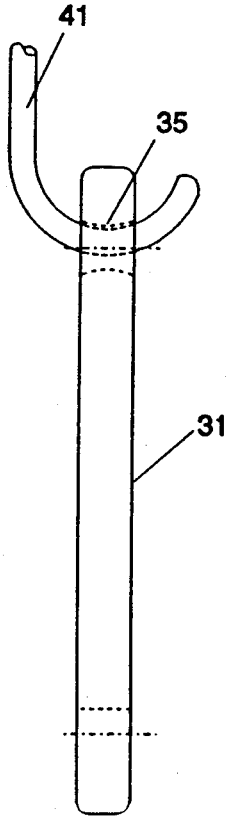
FIG. 6 is a side view of FIG. 5.

The bone, comprised of the same material as the T-rail (alumina) and shown individually in FIGS. 5 and 6, has a new longer stem (32), an overall length of 7" and a width of 5/6". The top attachment hole (33) of the bone will now be above the height of the seventh course of blanket (see FIG. 2). This is to allow the stainless steel hanger (41) to be above the seventh course of blanket and thus escape the radiant heat that is captured below. When repairs are made the longer stems make it possible to grab the stem to remove the bone. Taking a look at FIG. 6, the bone's attachment hole (33) is located ⅝" below the top of the bone. This hole is generally shaped as a curved cylinder (35) along its length, with a radius equal to that of the curved attaching portion of the hanger. This curved cylinder hole provides better total support for the T-tail as well as providing for equal pressure (rather than two concentrated stress points) on the bone stem leading to lesser instances of breakage.

The hanger device (41), comprised of stainless steel or suitable material, is designed such that when bone (31) and T-rail (11) are suspended therefrom it provides for a force vector (FIG. 2, No. 88) that extends from the hangers top end along and parallel to the bone's stem and continues along the T-rails web height, perpendicular to the T-rail's broad base portion. This hanger is designed in this fashion so that there will be no added stress upon the bone or the T-rail resulting from uneven suspension. Added assurance for retaining this force vector could be provided by placing a stopper means (for limiting hanger movement) on the said pipe on both sides of the hanger. For example one could attach a hose clamp to the pipe as this stopper means.

Referring again to FIGS. 1 and 2 the layers of insulation (70) will specifically be comprised of, first, two layers of refractory insulation board followed by seven layers of refractory insulation blanket, of decreasing grade. The first 2 courses of insulating board (71,72) will he 3' long instead of 18" long as has been previously done in other systems. These refractory insulating boards will be 12" wide with a 45° angle on both sides along the total length of the board. The angle is for expansion. When the insulating board is fired many times, it expands while at the same time the board loses its density. These angles will give way to the expansion while at the same time providing a proper seal. The boards before had no solution to the expansion problem and after expanding, the boards sagged in the middle aiding to the fatigue of the kiln crown. Both refractory insulation boards (71,72) are KAOWOOL board's manufactured by Thermal Ceramics Inc., Augusta, Ga. The first board (71) is rated to 3000° F., while the second insulation board (72) is rated at 2600° F. The 7 layers of blankets, same individual layer width as the boards, though of varying temperature ratings and compositions, are all manufactured by Thermal Ceramics Inc., same as the boards. The first two layers (73,74) are composed of KAOWOOL HIGH PURITY (HP) BLANKET, and are rated to 2300° F. The next four layers (75–78) are composed of KAOWOOL BLANKET B, and are rated to 1800° F. The final layer of insulation (79) is composed of KAOWOOL FOIL-BACKED BLANKET, and is rated to 2300° F. Although KAOWOOL products are used in this invention as the preferred embodiment, any companies insulating products which have the same compositions and ratings would be suitable.

Figure 10:
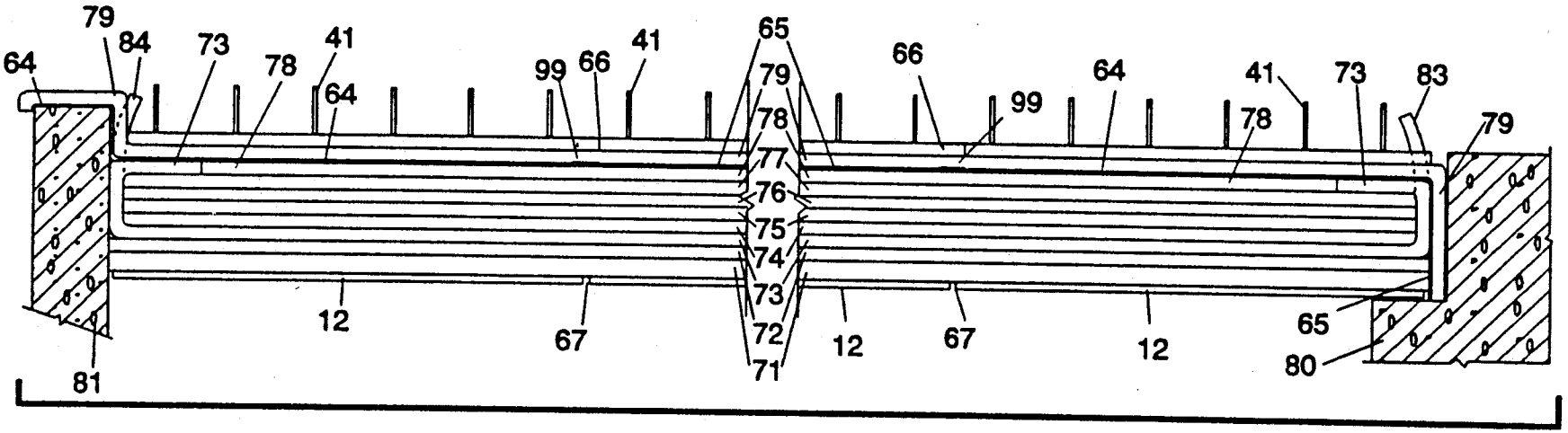
FIG. 10 is a diagrammatic representation of the insulation layers at both the front and the back of the kiln crown system.
Figure 12:
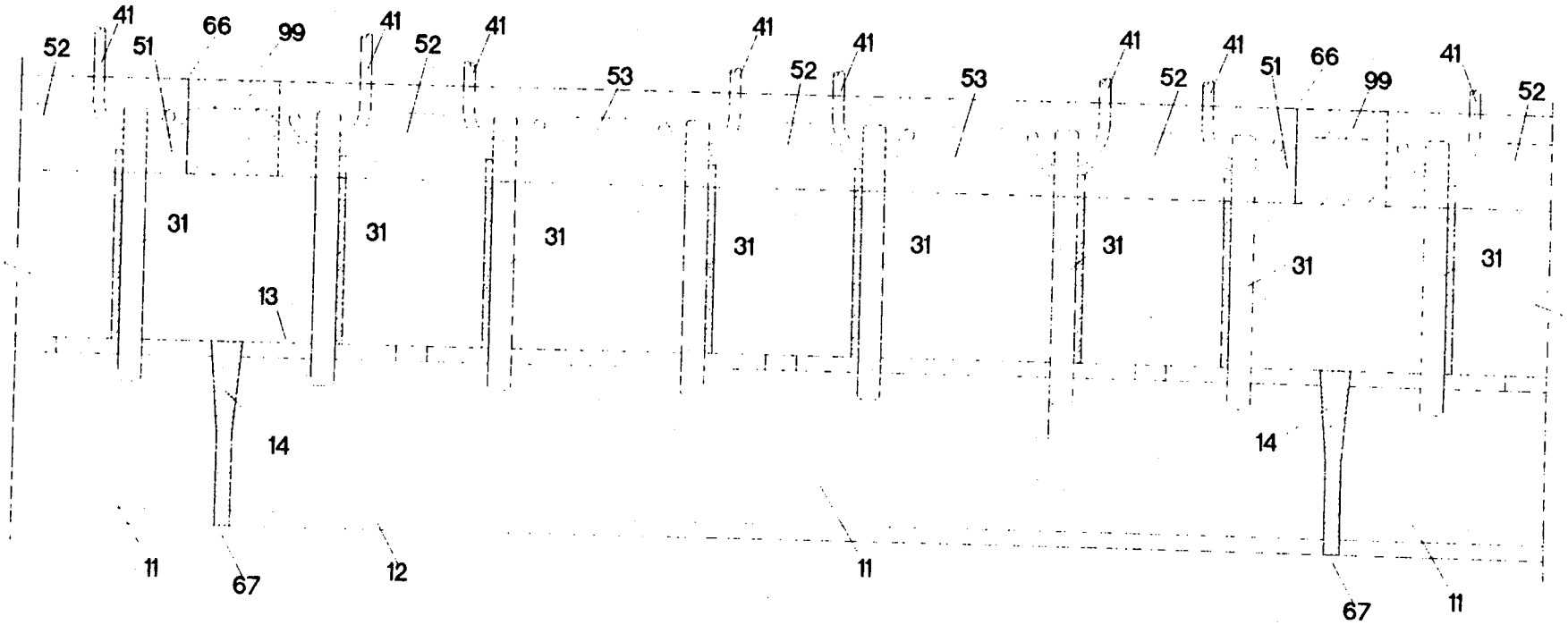
FIG. 12 is a diagrammatic representation of the overlapping thermal tent at the T-rail junction.
Figure 13:
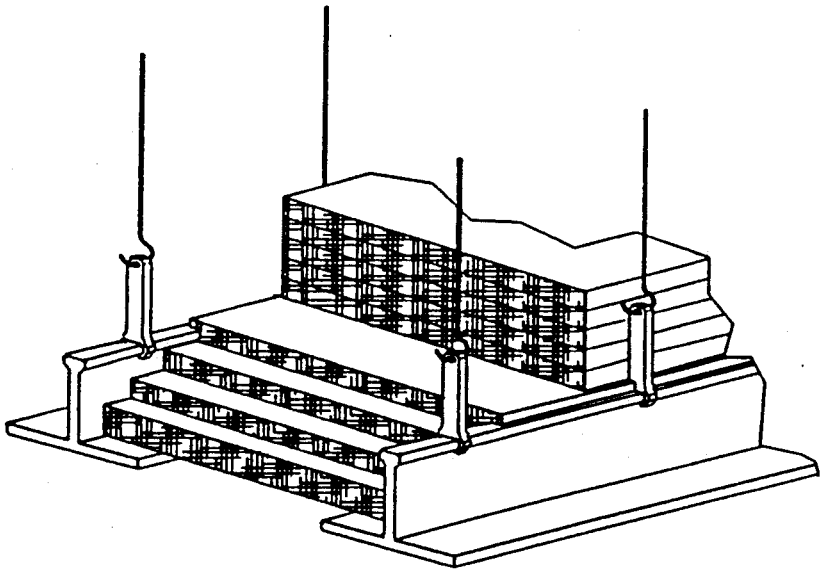
Fig. 13 PRIOR ART
FIG. 13 is a diagrammatic representation of the prior art kiln crown system.

Looking at FIG. 2 (end view) the thermal tent is comprised of an industrial aluminum foil designed for intense heat, although this may be any material which is suitable for insulating purposes. This thermal tent is formed by joining adjacent row aluminum insulation pieces which make up the aluminum layer. The aluminum foil layer (64A), formed of consecutively placed pieces, centers from the middle of the sixth course (78) of blanket, extends across to the cases and straight up the sides of the cases. The foil is then folded or attached together (63) above the ceramic bone, with the foil from the adjacent row (64B). The foil which is located at the hangers is pinched around each of the hangers. FIGS. 10 and 12 (side view) show the foil pieces that make up this layer will be 4" longer than the individual T-rail to allow 2" of overlap (99) on both sides of the T-rail junctions (i.e. fire joints). This gives added insulation at these areas of high heat loss. The thermal tent may have insulating blanket covering it if the thermal tent loses too much heat and requires more protection. Because of the increased length of the bone, the attachment portion of the bone, as well as the hanger device's lower portion, is above the insulation layers thus allowing the hanger to escape the intense heat which is found in the insulation layers, which in turn prolongs the life of the hanger device. The thermal tent is now needed to protect the bone from thermal shock now that it is above the insulation layers for hanger protection purposes. Even though some of the heat is now retained by the thermal tent it is considerably less than what is found in the insulation layers. Thus the combination of the increased bone length and thermal tent have allowed the hanger device to escape exposure to intense heat as well as protect the bone from thermal shock.

Additional protection for the hangers may be obtained by placing small orifices in the thermal tents above the middle of each insulation case. This would allow the heat which normally escapes along and up through the pinched thermal tent sections at the hangers to escape out these holes. Thus these orifices further protect the hangers from additional exposure to intense heat without subjecting the bone to thermal shock by just redirecting the normally escaping heat to exit out the orifices. Now looking at FIG. 3 the cases of insulation (51–53) are used to replace bulk wool packing, which was previously done. These rigid insulation cases are fitted securely and fully into the space formed between the bones, directly above T-rail and between adjacent, parallel insulation rows. There are three different cases, a fire joint case (51), slot case (52) and a stop case (53). The fire joint case (51) centers on the fire joint between the two T-rails. This case is 2" wide, 8⅜" long and 8" tall with a ½" 45° angle on both top ends. This fire joint case (51) is made by joining two 1" insulating boards with fire clay insulates between boards or in the alternative using one 2" board. The boards are 6⅜" long with a 1" strip of insulating blanket at each end making the overall length 8⅜". The 2" width, when centered over the T-rail, will provide a ½" overhang. The insulating blanket will now be compressed ½" to provide a better seal without disturbing the blanket. The cases all have 45° angles to provide room for the hangers to move freely as well as to give the hanger air and are designed to fit between the bones such that if the distance between the bones was to change, a modification in the size of the cases would remain within the teachings of the present invention. This fire joint cases protects against heat much better than the bulk wool packing which was previously used other systems.

The slot case (52) is centered over the slot. This case is 3⅞" overall length—2" wide and 8" tall with 45° angles. The board is 1⅞" with 1" of insulating blanket at each end. The insulating blanket is for expansion and vibration shock.

The stop case (53) has no blanket and is 3⅞" long, 2" wide and 8" tall with 45° angle at each end like the other cases. These insulation cases are unique in that they can easily be changed in size so as to retain the proper seal between insulation rows for efficient insulation. For example if the insulation is to shrink over time a thinner insulation case may be inserted next to an already placed insulation case so as to retain the tight fit which is most efficient. Additionally the old case could be removed and replaced with a wider one again retaining the tight fit required. Once again the above measurements are merely exemplary and may be modified within the scope of the invention.

These insulation cases (51–53) combine with the T-rail stopper means (15) to lock the ceramic bones (31) into place providing for better support of the T-rails system which in turn reduces the stress upon the said bones.

Referring to FIG. 1, the procedure for installation of the insulation of the new crown system is quite simple, and also an improvement over the old system. The kiln crown is now constructed in one controlled step. The old way, after suspension of the T-rail rows, you applied 6 courses of blanket then packed the crown with bulk wool then, applied the seventh course of blanket. The first part of the procedure (T-rail suspension) for the present invention involves hooking to hanger devices (41) a corresponding number of ceramic attachment bones (31). The next step involves placing the ceramic bones (31) in the slots of a inverted ceramic T-rail (11) and sliding the bone into its proper place using a stopper means (This slot stop system has been discussed previously and is shown in FIG. 8). The procedure is continues by rolling into position on the ultimate support system (43) a number of pipes (44) of adequate mechanical strength, a set distance apart and parallel to each other, such that the appropriate surface area is covered. Next, a number of T-rails (11), bones (31) and hangers (41) attached, which would be needed to form a row parallel and equal in length to the pipe, are placed end to end, an appropriate distance apart so as to compensate for thermal expansion. Finally, the last step requires one to suspend from the pipe (42) the T-rail/bone/hanger assemblies needed for this pipe, by attaching the hanger (41) to the pipe. This continues until you have formed inverted T-rail rows beneath all of the pipes. Thus the first has part of the method for constructing the kiln crown system has resulted in forming suspended, inverted and parallel T-rail rows.

Once the T-rails have been suspended the insulation is applied in the following fashion. The process begins at the kiln door (80) where, first, two Thermal Ceramic Inc. KAOWOOL boards [bottom board rated to 3000° F. (71), second board rated to 2600° F. (72)] are placed on top of each other, supported by and evenly separating the inverted T-rails (11) formed, with their ends positioned ½" from the point where the door (80) is positioned when closed. These 3' long boards are placed end to end until the back wall (81) is reached. The next step involves placing on top of these boards a layer of KAOWOOL HIGH PURITY (HP) BLANKET rated to 2300° F. (73) which overhangs in front and down below the boards (dotted line, 83) 36". Following this overhanging step, the procedure involves placing on top of the HP blanket another layer of KAOWOOL HIGH PURITY (HP) BLANKET rated to 2300° F. (74) followed by three layers of KAOWOOL BLANKET B rated to 1800° F. (75–77). The ends of these four blankets (74–77) are positioned so that their ends are equal to those of the insulation boards. Now the overhanging portion of first layer of HP blanket is repositioned so that it lays on top of the last layer of KAOWOOL BLANKET B. This repositioned portion forms the beginning 30" of that row as well forming a seal at the front of the kiln. This row of insulation is continued by placing and abutting up to the repositioned portion of the KAOWOOL HP blanket (73), another layer of KAOWOOL BLANKET B (78).

The blanket layers described above are all extended along the T-rail row and are applied by a person standing in the front of the kiln who is unrolling the blanket to another person who is laying on a plywood board which is on the pipes. The person on the board passes the blanket under the I-beam construction to a person between the next two I-beams. This bucket brigade system continues until the roll of insulation is finished. (the rolls of insulation are usually 50'). This process continues until the back of the kiln wall (81) is reached at which point a similar (with minor differences described in detail later) procedure as was used at the kiln door is implemented.

Once the first eight layers of insulation are completed At the layer of aluminum (64) which makes up the thermal tent is inserted. At the front edge of the kiln an aluminum piece having two sections is inserted such that: 1) one extends inward toward the kiln to just beyond the first T-rail junction (66) is and used to form the actual thermal tent and 2) the other (65) extends outward hanging over the kiln to a point on the same level as the bottom KAOWOOL board. Note that this aluminum piece is wide enough so that both sections (thermal tent and overhanging) can overlap with the corresponding aluminum row which will be formed in the row adjacent to it. Once the front wall two-section piece is in place, similar quality aluminum pieces of a size slightly longer than the individual T-rail, are placed consecutively so that they overlap slightly at the T-rail junctions (99) and continue until the back of the kiln wall (81), thus forming an aluminum layer (64) (See FIG. 12 for a better view of the size and overlap of these pieces). The thermal tent is formed by securing the one edge of this aluminum layer to the side of the kiln while leaving the other edge unattached. As the next adjacent row is insulated one edge, that closest to the completed row, of the new aluminum layer is secured by attaching it, above the ceramic bone, to the previously unattached aluminum layer edge in the just completed row. The other new edge is again left unattached for later attachment [See FIG. 2 for a diagram of the attachment area of the thermal tent (63)]. Note that the final layer in FIG. 10 labeled 64 is representative of the extension of the aluminum layer above the bones forming the thermal tent. Alternatively, this aluminum layer can be one continuous layer formed from unrolling standard rolls of this insulation quality aluminum, instead of placing consecutive pieces of aluminum to form this layer.

The last step involves placing on the aluminum layer, a layer of foil backed insulation (77) which is allowed to overhang to the same point as the overhanging aluminum layer. These two overhanging layers compress up against front edges of the installed rows when the kiln door (80) is closed forming a tight seal. This blanket is then unrolled in a similar fashion as the other blanket layers until the back wall (81) is reached forming the last insulation row.

The only major differences that occur at the back wall is that the insulation boards (71,72) are placed directly against the back wall and the repositioned overhanging section (dotted line, 84) runs along the back wall (81) before forming the first 30" of the 6th row (73). Also the back wall portion of the aluminum piece (68), as well as the final insulation layer (79) are draped over the back wall rather than hanging down over the front edge of the insulation layers as it does at the kiln door (83).

Once the row is completely insulated, insulation cases (51,52,53) are then placed in the spaces which are formed above the T-rail and between the ceramic bones. These cases are then pushed against the wall formed by the insulation layers compressing the insulation and forming a better seal against heat loss. The final and minor insulating step involves applying V-shaped plugs—2600 Blanket between the fire joints. In other words this step involves placing in the V-shaped groove (14 in FIG. 3) formed at the T-rails, insulation blanket which acts as both a shock absorber and a insulation heat sealer upon the expansion which occurs during firing. This complete insulation process is then repeated from row to row until the kiln crown is completely insulated.

The method of repair for this kiln crown is quite simple and comprises the following steps. The first step involves unfolding the thermal tent (at attachment area 63 in FIG. 2). The appropriate slot case is then removed. Referring to FIG. 3 it can be seen that in removing any of the three slot cases (53 A–C) any of the bones can be removed and thus the T-rail as well. Removal is accomplished by sliding a piece of tin down each side of the slot cases (53) and pulling them out without disturbing the insulating blanket. After completing the repairs by removing the damaged T-rail and/or ceramic bone the removed case(s) is/are replaced by placing it back into its proper case hole and pushing the case back into position. To complete the repair process the thermal tent (63) is refolded (at attachment area 63). In referring to FIG. 3 the hangers (41) are hooked to the bones (31) so that the hook portion is facing away from the entering slots where the slot insulation cases (53) are placed. This is important in this repair process because the hook portion will not catch on the slot insulation case when it is removed prior to kiln crown repair.

Figure 11:
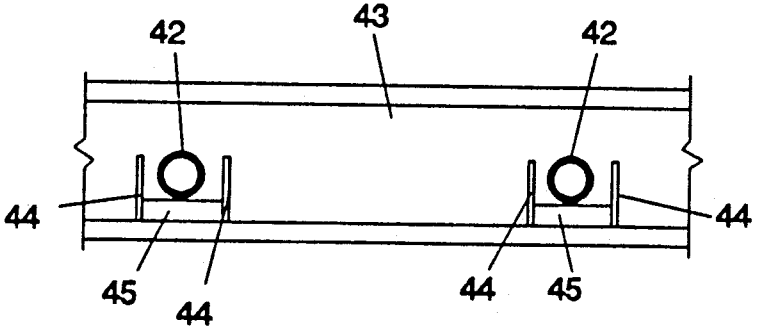
FIG. 11 is a diagrammatic representation of the variable height mechanism for the kiln crown system.

The ultimate support system as seen in FIG. 1 and FIG. 11 has stop mechanisms (44) applied to it on both sides of, equidistant (½") away from, the supported pipe (42). This controls the travel of the pipe (42) to ½" which reduces unexpected stress to the hangers (41), bones (31), and T-rails (11). Another benefit of these stops which limit travel of the pipes, is that the pipes would not have to be removed from the ultimate support means when the complete crown is removed and replaced thus saving time and effort.

Additionally these stops allow for an easy method of changing the height of a kiln crown system. Looking at FIG. 11 the steps, simply, are as follows: 1) placing, on the ultimate support member (43) on both sides of said kiln crown supporting pipe (42), pipe movement control mechanisms (44) of a height such that they cover the range of desired height movement and 2) placing under the pipe (42) a shim device (46) of a height equal to the height of crown movement desired. This method is especially desirable because when kilns are initially fired, they sometimes expand more than anticipated and the kiln crown will not match the height of the walls. Having this ability to adjust the kiln crown height allows kiln designers to easily match kiln crown placement height to that of the kiln walls.

Ultimate support system as used herein is shown as series of structural beams spaced at regular intervals, with a flat portion on which the pipe maybe placed and supported thereon. These beams may be independently supported by the buildings superstructure or may be supported by beams which have been secured to the ground and floor and/or which may be integrated with the kiln walls. Any other method for supporting this ultimate support system which may known to those in the applicable art may be suitable as well. In the invention taught herein, in the form of the preferred embodiment, the ultimate support means used comprises structural I-beams spaced approximately 5' apart. This ultimate support system of I-beams may be supported by another series of I-beams (not shown in the included Figure), secured into the ground and floor and perpendicular to these ultimate support I-beams. The ground and floor secured I-beams may also form the basis to which the refractory brick making up the wall is attached.

Further modifications of the invention herein disclosed will occur to those skilled in the respective arts and all such modifications are deemed to be within the scope of the invention as defined by the appended claims.

I claim:

1. A crown structure for furnaces and kilns used to fire materials at a high temperature comprising:

a. inverted T-rails which comrise:
   1. a slotted narrow attaching flange,
   2. a broad base flange parallel to said narrow attaching flange and
   3. a T-rail web which connects the two flanges, such that the T-rails form T-rail rows when placed end to end;

b. bone and hanger device combinations each combination including a bone and a hanger device for connection to said T-rails;

c. said bones including:
   1. a T-rail attachment end with an opening for attachment to said T-rail,
   2. a hanger attachment end with a hole for attachment to said hanger device and
   3. a stem connecting the two ends;

d. an ultimate support system capable of supporting the kiln crown sturcture including pipes for attachment of said hanger devices;

e. layers of insulation supported by and evenly separating the T-rail rows;

f. wherein said T-rails and said bones are made of suitable heat-resistant structural materials;

g. wherein the improvement includes the following modifications:
   1. said inverted T-rail is slotted forming slots along its narrow attaching flange, to allow for easier attachment and removal of the said bones, and stopper means forming stops to each side of the said slot such that the slot evenly divides the stops which thus allows said bones to be attached and positioned such that the said bones are evenly spaced upon said T-rail,
   2. rigid insulation cases fitted securely and fully into the space formed between said bones, above and within the space formed between said layers of insulation and
   3. said insulation cases and said T-rail stopper means combine to lock said bones providing for better support of the T-rails and thus for the entire crown stucture.

2. A crown structure as claimed in claim 1 wherein further improvement involves increasing the length of stem of said bone such that the said insulation layers reach a point on the hanger attachment end of the said bone slightly below the attachment hole.

3. A crown structure as claimed in claim 2 wherein further improvement involves utilizing an ultimate support system which has stop mechanisms applied to it on both sides of and equidistant from said supported pipe so as to control movement of said pipe.

4. A crown structure according to claim 3 wherein further improvement comprises utilizing an inverted T-rail which is angled at both ends, from the top narrower flange to a point intersecting along said T-rail's web approximately ½ way between the broad base flange and narrow attaching flange, such that when individual T-rails are placed end to end a V-shaped groove is formed.

5. A crown structure according to claim 4 wherein further improvement comprises utilizing an inverted T-rail which has a broad base flange, which supports said insulation layers, wide enough so that, when combined with the adjacent inverted T-rail's broad base flange width, the combined width is large enough to prevent sagging of said insulation layers over time, wherein the actual increase in the width of the broad base flange is based on a number of factors including the weight of insulation layers, the time period itself and the cost of said T-rail with the increased width of the broad based flange.

6. A crown system according to claim 5 wherein further improvement comprises utilizing a hanger device designed such that when said bone and said T-rail are suspended therefrom, said hanger device provides for a force vector that extends from said hangers top end along and parallel to said bone and continues along said T-rails's web height, perpendicular to said T-rail's broad base flange portion.

7. A crown system as specified in claim 6 wherein further improvement comprises enveloping said bone's hanger attaching end in a thermal tent comprising an insulation material, thus providing said hanger, protection from intense heat as well from thermal shock.

8. A crown system according to claim 7 wherein further improvement comprises utilizing a bone with a hanger attachment hole shaped as a curved cylinder with a radius equal to that of the hanger devices bottom hooking portion, thus providing constant pressure along the bone's attachment hole.

9. An attachable bone and inverted T-rail system for use in suspending a crown comprising:

a. inverted T-rails which include:
   1. a slotted narrow attaching flange,
   2. a broad base flange parallel to said narrow attaching flange and
   3. a T-rail web which connects the two flanges, such that the T-rails form T-rail rows when placed end to end;

b. said bones including:
   1. a T-rail attachment end with an opening for attachment to said T-rail, 2. a hanger attachment end with a hole for attachment to a hanger device and 3. a stem connecting the two ends;

c. said T-rails including a narrow attaching flange with three distinct widths, consisting of a narrow width slot means no wider than the T-rail's web width thus allowing bone to be inserted along the T-rail, a middle width slide means slightly narrower than the width of the bone's T-rail attachment opening thus allowing the bone to slide along the said slide means, and a wide width stop means wider than the aforementioned bone's T-rail attachment opening thus not allowing movement of the bone past said stopper means.

10. An attachable bone and inverted T-rail system as claimed in claim 9 wherein said T-rail's slot means is positioned in the middle between opposing said slide means and said stop means, such that once said bones are placed in position by sliding them up against said stop means each said positioned bones may be easily removed without disturbance of any other.

11. An attachable bone and inverted T-rail system as claimed in claim 10 wherein said T-rail's slot and stop means are positioned such that when said bones are slid into position each of said bones are equally spaced along said T-rail improving the balance and support of said T-rail.

12. An inverted T-rail for attachment to a suspension means with a constant width attachment opening, wherein said T-rail comprises, a narrow attaching flange and a base broad flange and a T-rail web connecting the two flanges, wherein the narrow attaching flange contains three distinct widths, a narrow width slot means approximately as wide as the T-rail's web, a middle width slide means slightly narrower than the width of the suspension means attachment opening, and a wide width stop means wider than the width of the suspension means attachment opening.

* * * * *